United States Patent [19]

Plaschy

[11] Patent Number: 4,805,276

[45] Date of Patent: Feb. 21, 1989

[54] MONITORING DEVICE FOR DOUBLE THREADS IN WARP TYING MACHINES

[75] Inventor: Martin Plaschy, Hombrechtikon, Switzerland

[73] Assignee: Zellweger Uster Ltd., Uster, Switzerland

[21] Appl. No.: 878,005

[22] Filed: Jun. 24, 1986

[30] Foreign Application Priority Data

Jun. 26, 1985 [CH] Switzerland ..... 02716/85

[51] Int. Cl.[4] ..... D03J 1/18

[52] U.S. Cl. ..... 28/187; 28/211

[58] Field of Search ..... 73/862.47, 862.48, 862.65; 28/211, 185, 187, 209, 211

[56] References Cited

U.S. PATENT DOCUMENTS

| | | | |
|---|---|---|---|
| 2,369,536 | 2/1945 | Crandall | 28/211 |
| 2,928,159 | 3/1960 | Altenweger | 28/187 |
| 3,280,623 | 10/1966 | Saxl | 73/862.65 |
| 3,526,130 | 9/1970 | Canfield | 73/862:65 X |
| 3,765,777 | 10/1973 | Williams, Jr. | 28/187 |
| 3,840,951 | 10/1974 | Townsend | 28/187 |
| 4,164,805 | 8/1979 | Altenweger . | |
| 4,233,837 | 11/1980 | Canfield | 73/862.48 |
| 4,411,159 | 10/1983 | Spear et al. | 73/862.65 X |

FOREIGN PATENT DOCUMENTS

| | | | |
|---|---|---|---|
| 875029 | 4/1953 | Fed. Rep. of Germany | 28/211 |
| 1118109 | 11/1961 | Fed. Rep. of Germany | 28/211 |
| 1560548 | 1/1977 | Fed. Rep. of Germany . | |
| 47-789 | 1/1972 | Japan | 28/211 |
| 4829823 | 9/1973 | Japan | 28/211 |
| 348937 | 10/1960 | Switzerland . | |
| 619011 | 8/1980 | Switzerland . | |
| 506656 | 5/1976 | U.S.S.R. | 28/211 |
| 839400 | 6/1960 | United Kingdom . | |

*Primary Examiner*—Robert R. Mackey

*Attorney, Agent, or Firm*—Burns, Doane, Swecker & Mathis

[57] ABSTRACT

A tying machine includes a tying device, grippers for two groups of warp threads ($K_a$, $K_n$) which are to be tied together and a device for separating the outermost warp thread of each group and moving it out of the plane of the warp. In the region between the separating device and a gripper, the warp threads are guided over a thread guide where the outermost warp thread is deflected and moved out of the plane of the warp. A measuring device for measuring the force exerted by a deflected warp thread on the point of deflection or on the separating device is arranged in the region of deflection, and the signal of this measuring device serves as criterion for the presence of a double thread. The measuring device may be a piezoelectric pressure convertor or an elongation measuring strip or a piezo sensor which is sensitive to deflection. Thus, the measuring device is virtually unaffected by dirt or dust. Since the signal produced by a double thread is twice as great as that produced by a single thread, such double threads are reliably recognized.

19 Claims, 3 Drawing Sheets

MONITORING DEVICE FOR DOUBLE THREADS IN WARP TYING MACHINES

BACKGROUND OF THE INVENTION

This invention relates to a monitoring device for double threads in warp tying machines having a tying device, grippers for the groups of warp threads to be tied together, and a device for separating the outermost warp thread to move it out of the plane of the warp.

It is known to ensure the correct sequence of individual threads within the warp by inserting a so-called lease into the warp, in most cases with the aid of two leasing cords. In a device of this kind, as described in Swiss Pat. No. 619,011, the separating devices separate the outermost warp thread from the layer of warp threads by changing their position in relation to the layer of the warp threads together with the leasing cords after separation of a thread so that all threads following the next outermost warp thread are displaced by the latter. In this case, therefore, the separation of double threads is prevented by the cooperation of the leasing cords with the separating device.

Additional safety against the separation of double threads is achieved according to Swiss Pat. No. 348,937 by designing the separating device, e.g. a notched needle, in such a manner that it can only separate one thread.

If, however, a lease is used, then the prevention of separation of double threads depends solely on the correct choice of separating needle in accordance with the given yarn diameter. Even then, however, two or in exceptional cases even more than two warp threads are liable to be separated, especially if the warp threads have been sized. This has the undesirable result that the dying device produces a so-called three-legged knot. Two different types of problems then arise, depending on the position of the double thread:

If the double thread lies on the side of the old warp, i.e., if two warp threads of the old warp are tied to a warp thread of the new warp, then thread breakage occurs at the latest at the level of the first row of drop wires since the two threads of the double thread are drawn into different drop wires. This thread breakage must be repaired by the manual insertion of a piece of thread. In addtion, a missing warp thread must be supplied to the new warp from an edge of the group of threads for the second thread of the double thread.

If the double thread lies on the side of the new warp, i.e. if a warp thread of the old warp is tied to two warp threads of the new warp, then these two new warp threads together with one old warp thread are drawn through the associated drop wire, through a heald and through a tube of the reed. The fault is then not detected until the starting place is reached and one of the two new warp threads of the double thread must be cut off, pulled backwards out of the reed, heald and drop wire and deflected and removed at one side of the beam.

Apart from the fact that elimination of both these types of faults requires an undesirable amount of manual operation, the double threads are liable to impair the quality of the woven fabric. For example, if the number of warp threads which have had to be deflected and removed from the side exceeds a certain value, such as four, differences in tension are then liable to occur in the new warp resulting in a poor quality of weave.

It is therefore necessary to prevent the formation of three-legged knots. In other words, double threads must always be detected in good time before the tying process is performed.

The problem of detecting double threads is also found in other textile fields, for example in winding. German Auslegeschrift No. 1,560,548 discloses a winding machine having a monitoring device for the tying of double threads. The device comprises a measuring instrument for measuring the thread dimensions in the path of the thread downstream of the tying device. Measuring of the thread dimension may be carried out, for example, by optical means.

Optical measurement of the thread dimension always entails a certain risk of error due to dust formed in yarn processing. Moreover, it is not ideal to place the measuring instrument downstream of the tying device as this cannot prevent the formation of a three-legged knot.

The invention serves to provide a monitoring device for double threads which will not only effectively detect double threads and hence prevent the formation of three-legged knots but is also substantially immune to the presence of dirt and dust.

BRIEF SUMMARY OF THE INVENTION

The problem of three-legged knots is solved according to the invention by guiding the warp threads over a thread guide in the region between the separating device and a thread gripper so that the outermost warp thread is deflected over this thread guide as it is moved out of the plane of the warp. A measuring device is provided in the region of deflection of the outermost warp thread to measure the force exerted on the point of deflection or on the separating device by a deflected warp thread. A measuring signal obtained is used as the criterion for the presence of a double thread.

Measurement of the force in the region of deflection by a suitable sensor is virtually unaffected by dust and dirt if the sensor used consists, for example, of an elongation measuring strip, a piezoelectric sensor sensitive to deflection or a piezoelectric pressure convertor. Practical experiments have shown that the measuring signal obtained is twice as great from a double thread and three times as great from a triple thread as that obtained from a single thread and is therefore a reliable cirterion for the recognition of a double thread.

BRIEF DESCRIPTION OF THE DRAWINGS

The invention is described below with the aid of constructional examples illustrated in the drawings wherein like reference numerals are applied to like elements and wherein:

FIG. 2 represents an enlarged partial section through the thread guide in the region of the sensor in FIG. 1 with the plane of section lying in the plane of FIG. 1;

FIG. 3 is an end view in the direction of the arrow III of FIG. 2 shown on an enlarged scale;

DESCRIPTION OF THE PREFERRED EMBODIMENTS

Figure 1:
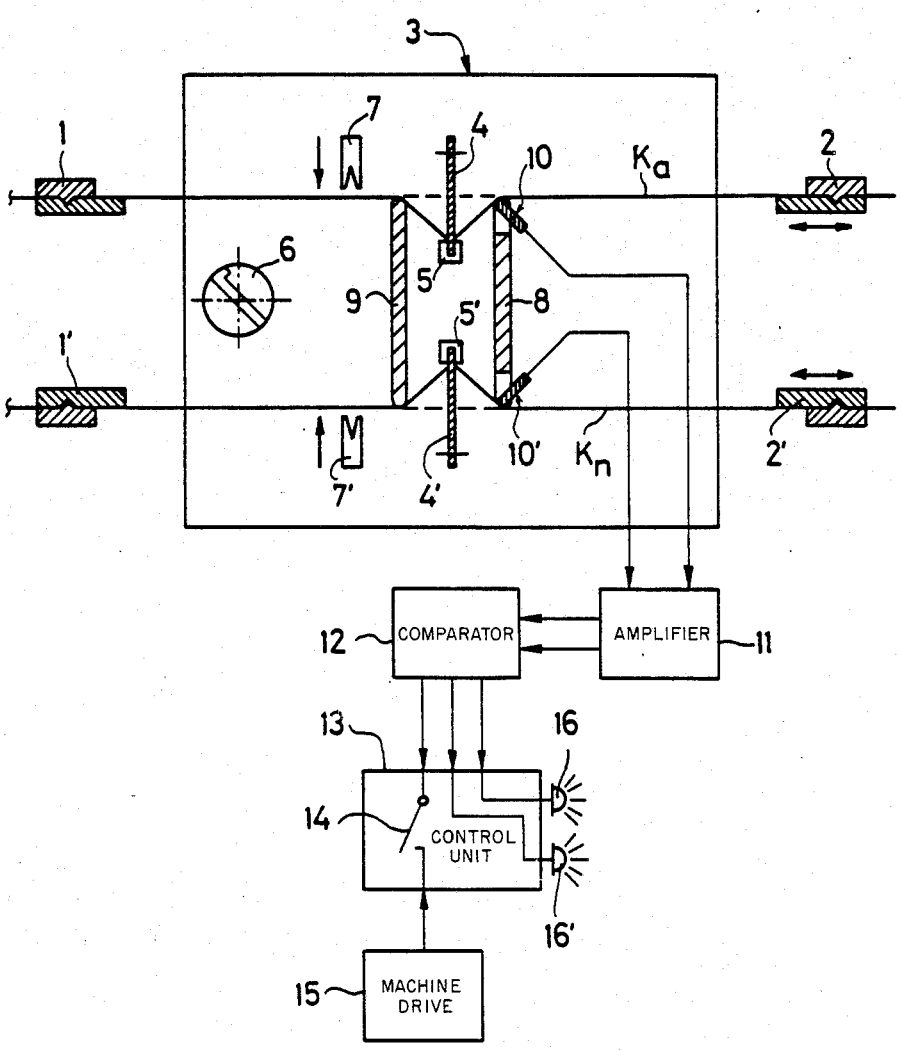
FIG. 1 is a schematic representation of a warp tying machine equipped with a monitoring device according to the invention.

FIG. 1 shows two groups of threads, $K_a$ and $K_n$ clamped between two gripper rails 1,2 and 1',2', the upper group of threads $K_a$ forming an old warp and the lower group of threads $K_n$ a new warp which is to be tied to the old warp. One of the two gripper rails for each group of threads $K_a$ and $K_n$, e.g. the gripper rail 2 and the gripper rail 2', is displaceable in relation to the other rail of the group so that the tension in each group of threads $K_a$ and $K_n$ can be individually adjusted. The two adjustable gripper rails 2, 2' are arranged at zones spaced in the threadwise direction and located near the free ends of the threads $K_a$, $K_n$. In addition, the adjustable gripper rails permit tension to be adjusted in at least the edge portion of the group of threads.

The groups of threads $K_a$, $K_n$ pass through the range of action of a tying machine 3. In practice, the tying machine 3 is placed at one of the two lateral edges of the groups of threads $K_a$, $K_n$ and moved transversely to these groups of threads. With each successive cycle of operation, one thread of the old warp $K_a$ and one thread of the new wrap $K_n$ are tied together. The tying process basically uses a separating means or device 4, 4', respectively, for each of the two thread groups $K_a$, $K_n$. In each operating cycle, the separating device 4, 4' engages and separates the outermost warp thread of the group and presents it to a feed device 5, 5' which conveys the thread to a tying device 6. In this process, each of the two threads is gripped by a thread gripper (not shown) and the ends of the threads are then cut off by shears 7, 7' arranged between the feed devices 5, 5' and the tying device 6.

Since the tying machine 3 is not, as such, an object of the present invention, only those parts essential for an understanding of the invention have been shown in FIG. 1. A tying machine 3 of the type described is known and is marketed by the assignee hereof under the name USTER TOPMATIC.

Two thread guides 8, 9 on which the threads of the two groups $K_a$, $K_n$ lie are arranged one on each side of the separating devices 4, 4'. The distance between these thread guides is relatively small, amounting to only a few millimeters. In the rest position, the threads assume the position shown in broken lines between the thread guides 8, 9 while the separating devices 4, 4' are arranged so that in each case the end of the thread guide facing its group of threads is arranged above the group of threads $K_a$ or, respectively, below the lower group of threads $K_n$. To separate the outermost warp thread, the upper separating device 4 is moved downward and the lower separating device 4' is moved upward. By means of a notch arranged at its end face of the separating device 4, 4' and adjusted to the diameter of the thread, the separating device 4, 4' only takes hold of the one outermost warp thread and pushes it downward or upward out of the plane of the group of threads $K_a$, $K_n$ from which it was taken, i.e., the warp thread plane.

As the outermost warp threads are moved out of the plane of their group of threads, they are deflected over the contact surfaces of the guide 8, 9 and act on the contact surfaces of the separating device to exert on them a force which is greater than that exerted by the outmost warp thread at rest (shown in broken lines) owing to the increasing thread tension (Hookes law).

This force varies according to whether the two or more warp threads are deflected about the contact surface of the respective thread guide. Experiments with threads of different yarn counts have shown that the force acting on the contact surface is twice as great when two threads are deflected simultaneously and three times as great when three threads are deflected as that exerted when only one thread is deflected.

Normally, only one outermost warp thread is separated at a time. The separation of two threads, a so-called double thread, results in formation of a three-legged knot, which should be avoided at all costs. The separation of a double thread should therefore be indicated before the tying process takes place.

In the tying machine 3 illustrated in FIG. 1, the above-mentioned dependence of the force acting on the point of deflection and on the separating device upon the number of deflected threads is used for monitoring and detecting the presence of double threads. Briefly, the detection is accomplished with a fault detecting means which senses a value related to the magnitude of the force exerted by said separating means in each of the successive thread deflecting operations. The fault detecting means produces an error signal when the sensed value does not correspond to a predetermined force which is essentially the approximate force required for deflecting a single thread.

The fault detecting means includes a displaceable guide means which supports the thread which has been separated from the group of warp threads. The guide means is movable in response to deflection of the separated thread from the warp thread plane. In addition, the fault detecting means includes a sensing means which detects movement of at least a portion of the guide means and generates a signal value which is related to the force applied to the thread that is separated by the separating means.

The monitoring may be carried out by means of sensing means such as sensors 10, 10', one being installed in each of the two thread guides 8, 9 for the two groups of threads $K_a$, $K_n$. FIG. 1 shows the sensors 10, 10' arranged on the thread guide 8 facing the free ends of the threads, with the sensor 10 placed on the upper group of threads $K_a$ and the sensor 10' placed on the lower group of threads $K_n$. It should be noted, however, that the sensors 10, 10' could equally well be placed on the thread guide 9 facing the tying device 6 or they could even be placed one on each of the two thread guides 8, 9. Furthermore, the sensors 10, 10' could be arranged on the separating devices 4, 4', for example where the separating devices are mounted.

The sensors 10, 10' could in principle be any measuring elements suitable for indicating the forces acting on the deflecting points of the thread guides 8, 9. Piezoelectric convertors and elongation measuring strips (i.e., strain gauges) have proved to be particularly suitable.

The measuring signal of the sensors 10, 10' is transmitted to a control means having an amplifier 11, an evaluating stage 12, and a control unit 13. The amplifier 11 amplifies the measuring signal and transmits it to the control unit 13 of the tying machine 3 by way of the evaluating stage 12. The evaluating stage 12 is a suitable conventional comparator which compares the amplified signal to a predetermined threhsold value related to the force exerted by a single thread. In addition, the evaluating stage 12 sends appropriate signals to the control unit 13 for operating visual indicators and a switching device. The control unit 13 includes, inter alia, a means for interrputing or controlling operation of the machine, such as a switch 14 that is capable of switching off the drive 15 of the tying machine 3. The control unit further includes two double thread visual indicators 16, 16', one for the upper and one for the lower group of threads $K_a$, $K_n$. If, for example, the sensor 10 for the upper group of threads $K_a$ detects that the thread separated by the separating device 4 exerts a higher force on the thread guide 8, corresponding to the presence of a double thread, then the measuring signal obtained after amplification in the amplifier 11 acts on the switch 14 to stop the tying machine 3 and to turn on the double thread visual indicator 16 to produce a visual signal. The indicator 16 signals the presence of a double thread in the upper group of threads $K_a$. The other indicator 16' signals the presence of a double thread in the lower group of threads $K_n$.

The evaluating stage 12 is designed to be automatically calibrated for the contact force of an individual thread of the given group of threads as a predetermined reference value or threshold value, since the contact force depends on characteristics of the particular thread such as the yarn count, the material of the thread and the tension between the gripper rails 1, 2 and 1', 2'. It is also possible to regulate the warp thread tension between the gripper rails to a given value on the basis of the contact force.

The thread guides 8, 9 indicated schematically in FIG. 1 may in practice be in the form of flat plates, for example, and extend perpendicularly to the plane of the drawing. The groups of threads $K_a$, $K_n$ lie on the part of these guides which is situated to the front with respect to the observer. As soon as one of the separating devices 4, 4' has gripped an outermost warp thread and pushed it out of the plane of its group of threads to present it to its corresponding feed device 5, 5', the separating device and outermost warp thread move perpendicularly to the plane of the drawing and the outermost warp thread slides on its thread guides 8, 9 to reach the portion of the thread guide 8 on which the sensors 10, 10' are situated. In this location, measurement of the contact force then takes place.

Figure 2:
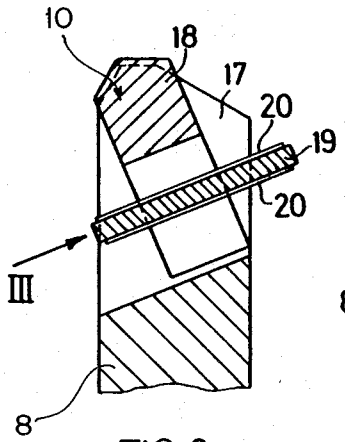

According to FIG. 2, the contact part of the thread guide 8 includes a rigid part or element 17 and a rocking part or element 18 displaceably mounted on the rigid part 17. The rocking part 18 is unilaterally attached to the rigid part 17 by a leaf spring 19. According to the drawing, the group of warp threads $K_a$ lies on the left-hand part of the rigid part 17 and on the adjacent area of the rocking part 18, which is the part of the tread guide 8 facing the observer in FIG. 1. When the separating device 4 (see FIG. 3) is moved downward in the direction of the arrow A, it separates the outermost warp thread $K_r$ and deflects it out of the plane of the group of threads $K_a$. The separating device 4 is then displaced to the right in the direction of the arrow B and pulls the separated outermost warp thread $K_r$ away from its group of threads $K_a$ over the rocking part 18 and the separated thread then slides along this rocking part 18. The warp threads are prevented from slipping into the gap between the rigid part 17 and the rocking part 18 by means of lateral guides (not shown) arranged in this region.

The contact force is measured in the region of a measuring point M which, for the sake of making use of the force of leverage, is situated on the rigid part 17 at some distance from the point of attachment of the leaf spring 19. The leaf spring 19 has an elongation measuring strip 20 on each of the two surfaces which are the upper and the lower surfaces with respect to the direction of the contact force of the outermost warp thread $K_r$, and each of these strips 20 has a connection 21 for a cable leading to the amplifier 11 (FIG. 1). Instead of the elongation measuring strips 20, a piezoelectric sensor sensitive to deflection may be used.

Figure 3:
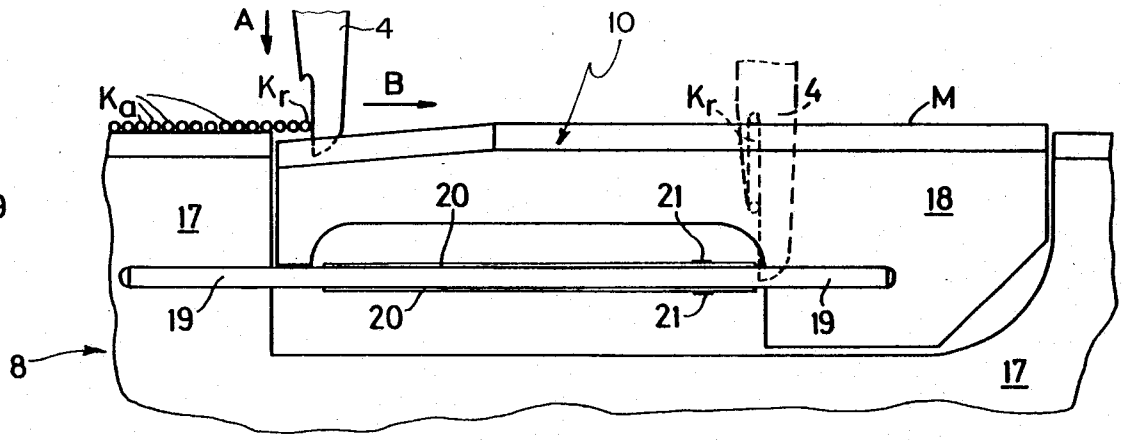
FIGS. 2 and 3 are two different views of a first embodiment given by way of example of a detail of FIG. 1.

In the example illustrated in FIGS. 2 and 3, the contact force exerted by the outermost warp thread $K_r$ is measured by means of the elongation of the elongation measuring strip 20 mounted on the leaf spring 19. A much more powerful measuring signal is obtained by measuring the deflection of the rocking part 18, i.e., by arranging the elongation measuring strip between the rocking part 18 and the rigid part 17 of the thread guide 8. Such an arrangement is illustrated in FIG. 4.

Figure 4:
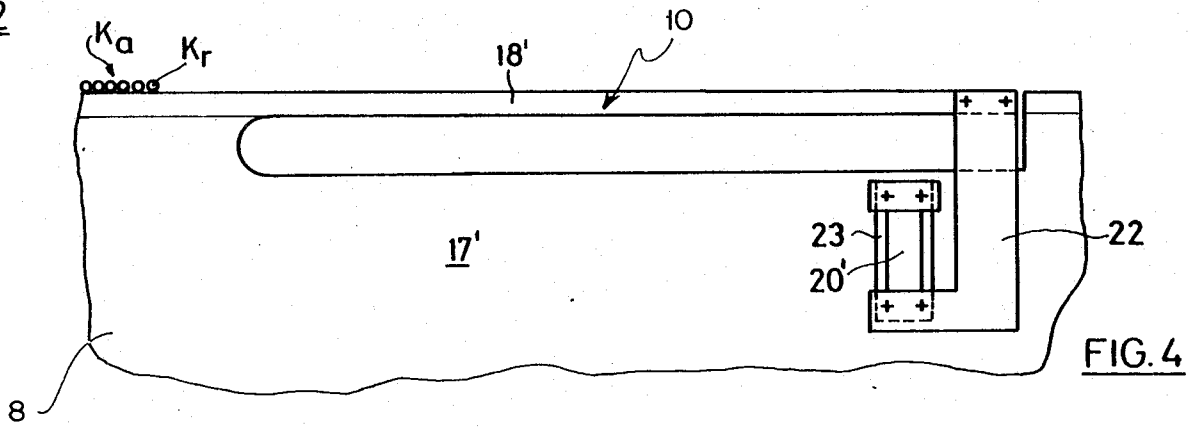
FIG. 4 shows another embodiment of the device of FIG. 1.

According to FIG. 4, the rocking part 18' may be a tongue extending away from the rigid part 17' of the thread guide 8. An L-shaped link plate 22 is attached in the region of the free end of the tongue, the lower arm of this link plate 22 extending under the top edge of the rigid part 17' in this region. The lower end of an elongation measuring strip 20' is clamped to the lower arm of this link plate 22 while the upper end of the strip 20' is fixed to the rigid part 17'. The elongation measuring strip 20' is either arranged between the rigid part 17' and the rocking part 18' without a special support or, as indicated in FIG. 4, it is applied to a small plate 23 of elastic plastic, preferably by being cast into this plate. Calculation shows that this measuring arrangement may be expected to produce a measuring signal which is about 20 to 30 times as great as that obtained from the arrangement of FIGS. 2 and 3. Practical experiments have shown that deflection of the rocking part 18' by $10^{-5}$ mm. produces an elongation of the elongation measuring strip 20' of $10^{-3}$ mm/m, which corresponds to about 35 times the measuring signal obtained with the arrangement of FIGS. 2 and 3.

Figure 5:
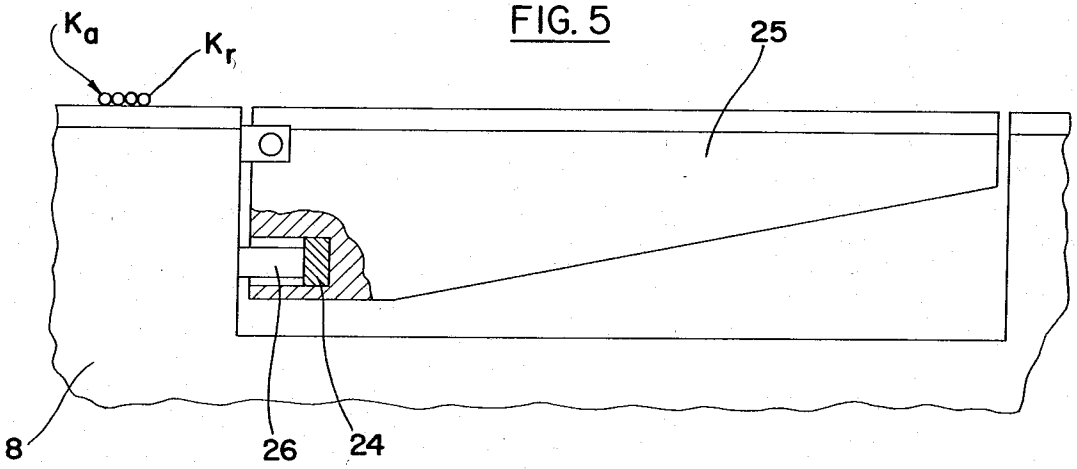
FIG. 5 illustrates a third embodiment of the device of FIG. 1.

According to another variation of the method (see FIG. 5) of measuring the force of contact of the outermost warp thread, a piezoelectric convertor 24 is used for this measurement instead of an elongation measuring strip. For this purpose, a suitable deflecting element 25 for the outermost warp thread is arranged laterally to the thread guide 8 to extend slightly beyond the contact surface of the thread guide. Such a deflecting element 25 may be, for example, stirrup-shaped or flat, and is mounted on a supporting shaft 26 which makes contact with the piezoelectric convertor 24. When the separated outermost warp thread $K_r$ is moved away from its group of threads $K_a$, it is pushed on this deflecting element 25 and the force of contact which it exerts on this element produces a force acting on the piezoelectric convertor 24 in the longitudinal direction of the supporting shaft 26.

Other embodiments of the monitoring device described are conceivable and lie within the competence of a person of ordinary skill in the art. In such additional embodiments, the presence of double threads should be monitored by means of the force of contact of a separated outermost warp thread on its respective guide or point of deflection or on the separating device.

It will now be apparent that the present invention provides a novel device for determining the presence of double threads. Moreover, it will be apparent to those skilled in the art that there are numerous modifications, variations, substitutions and equivalents for the features of this invention which do not materially depart from the scope of the invention. Accordingly, it is expressly intended that all such modifications, variations, substitutions and equivalents that fall within the spirit and scope of the appended claims be embraced thereby.

What is claimed is:

1. In a tying machine for tying individual threads of a first warp sheet to correspondingly positioned individual threads of a second warp sheet, said machine being of the type in which threads from at least an edge portion of a warp sheet are gripped at zones spaced apart from each other in the lengthwise direction of the threads and in which individual threads at the outermost edge of said warp sheet are successively engaged by separating means on successive cycles of machine operation to deflect them one by one out of the plane of such warp sheet, said machine having grippers, means to feed separated threads to the tying machine, guides for the separated threads, there being a separating means, feed means, guide, and gripper for each of the two warp sheets, the improvement which comprises fault detecting means for each warp sheet for sensing a value related to the magnitude of the force exerted by said separating means in each of its thread deflecting operations and for producing an error signal when the sensed value does not correspond to the approximate force required for deflecting a single thread, and when the sensed value corresponds to the approximate force required for deflecting multiple threads, the fault detecting means being positioned in the tying machine relative to the warp sheet such that the force exerted by each outermost thread of the warp sheet is successively sensed.

2. The machine of claim 1 wherein the fault detecting means includes:

a displaceable portion of the guide means for supporting the separated thread, the displaceable portion of the guide means being movable relative to the machine in response to deflection of the separated thread from the plane of the warp threads; and sensing means for detecting movement of said displaceable portion of the guide means to generate the signal value related to force applied to the separated thread by the separating means.

3. The machine of claim 2 further including control means for comparing the sensed signal value and a threshold signal and providing a visual signal when the sensed signal value exceeds the threshold signal.

4. The machine of claim 3 further including means for interrupting operation of the machine when the sensed signal value exceeds the threshold signal.

5. The machine of claim 1 wherein:

the guide means includes a fixed element, a rockable element connected thereto, and a shaft member extending between the fixed element and the rockable element; and the sensing means includes a piezoelectric element positioned relative to the shaft member such that movement of the rockable element causes the shaft member and the piezoelectric element to be pressed together to generate the signal.

6. The machine of claim 1 wherein:

the guide means includes a fixed element, a rockable element, and a leaf spring connecting the rockable element to the fixed element; and the sensing means includes a strain gauge mounted on the leaf spring.

7. The machine of claim 1 wherein:

the guide means includes a fixed element and a rockable element rigidly connected to the fixed element at one end so that a second end of the rockable element is displaceable; and the sensing means includes a strain gauge mounted between the second end of the rockable element and an adjacent portion of the fixed element.

8. Apparatus for monitoring a warp tying operation to detect the presence of double threads comprising: a tying device, grippers for planar groups of warp threads to be tied together, a device for separating the outermost warp thread of from each planar group of warp threads and moving it out of the warp thread plane, a feed means for receiving the separated warp thread from each group and directing the separated warp thread to the tying device for joining of the separated outermost threads of each group, a thread guide in the region between the separating device and the gripper of each group of warp threads, threads being passed over the thread guide, the outermost warp thread being deflected and moved out of the warp thread plane by the separating device, a measuring device for measuring force exerted by a deflected warp thread being arranged in the region of deflection of the outermost warp thread of each group of warp threads, being associated with the thread guide, and generating a measuring signal, the measuring signal obtained from the measuring device serving as the criterion for the presence of a double thread when the sensed value exceeds the approximate force required for separating a single thread.

9. The apparatus according to claim 8 wherein, in the region adjacent to the group of warp threads, the thread guide has a part which is capable of being displaced by a deflected outermost warp thread and over which the separated outermost warp thread is moved, and the measuring device is arranged in the vicinity of this part.

10. The apparatus according to claim 9 wherein the thread guide is composed of a rigid part and a rocking part which is mounted on the rigid part and forms said displaceable part, and the measuring device is designed to detect the displacement of this rocking part by a separated outermost warp thread.

11. The apparatus according to claim 10 wherein the rocking part is mounted unilaterally on the rigid part by a leaf spring and the measuring device is formed by two elongation measuring strips fixed to opposite sides of this leaf spring.

12. The monitoring device according to claim 9 wherein the thread guide is designed to be deflected by a separated outermost warp thread in the region of the displaceable part and the measuring device is formed by an elongation measuring strip clamped between the displaceable part and the remainder of the thread guide.

13. The monitoring device according to claim 12 wherein the elongation measuring strip is applied to a support of elastic plastic.

14. The monitoring device according to claim 12 wherein the elongation measuring strip is embedded in a support of elastic plastic.

15. The monitoring device according to claim 9 wherein the displaceable part is connected to a piezoelectric convertor, the force of which displaceable part acting on the convertor is proportional to the force of contact of a separated outermost warp thread.

16. The monitoring device according to claim 15 wherein the said displaceable part is mounted on a shaft which is oriented in the direction of the force of contact and makes the contact with the piezoelectric convertor.

17. The apparatus according to claim 8 wherein the measuring signal of each measuring device is transmitted to a control unit of the typing machine by way of an amplifier and an evaluating stage.

18. The apparatus according to claim 17 wherein the evaluating stage has a threshold value detector for the measuring signals, the threshold value of which detector is adjusted so that a measuring signal exceeding this value indicates the separation of a double thread.

19. The apparatus according to claim 18 wherein the control unit of the tying machine has a switch for controlling the connection to a drive and separate indicators for the appearance of a double thread in each of the two groups of warp threads, and the switch and the indicators are activated by the output signal of the evaluating stage.

* * * * *